United States Patent [19]

Ceelen

[11] Patent Number: 4,919,411

[45] Date of Patent: Apr. 24, 1990

[54] PAPER FEEDING DEVICE

[75] Inventor: Theodorus M. Ceelen, LaVerne, Calif.

[73] Assignee: Xerox Corporation, Stamford, Conn.

[21] Appl. No.: 71,826

[22] Filed: Jul. 10, 1987

[51] Int. Cl.[5] ..... B65H 3/52; B65H 3/04

[52] U.S. Cl. ..... 271/35; 271/121; 271/124; 271/167

[58] Field of Search ..... 271/34, 35, 169, 170, 271/121, 125, 114, 116, 124, 127, 126, 119, 120, 122, 226, 229, 245, 137, 138; 198/384, 385

[56] References Cited

U.S. PATENT DOCUMENTS

| | | | |
|---|---|---|---|
| 1,643,646 | 9/1927 | Swift | 271/35 |
| 2,665,787 | 1/1954 | Ribich | 271/114 X |
| 2,922,643 | 1/1960 | Lopez | 271/35 |
| 3,151,863 | 10/1964 | Lohr | 271/121 |
| 3,612,512 | 10/1971 | Lang | 271/35 |
| 3,874,652 | 4/1975 | Bilbrey | 271/35 |
| 3,968,959 | 7/1976 | Johnson et al. | 271/137 |
| 4,106,764 | 8/1978 | Tamura | 271/35 |
| 4,203,586 | 5/1980 | Hoyer | 271/125 X |
| 4,302,000 | 11/1981 | Frank | 271/34 X |
| 4,405,124 | 9/1983 | Watanabe | 271/138 X |
| 4,526,358 | 7/1985 | Ura et al. | 271/124 X |
| 4,544,147 | 10/1985 | Dinnissen | 271/35 |
| 4,548,397 | 10/1985 | Runzi | 271/121 |
| 4,653,743 | 3/1987 | Ebata et al. | 271/124 |
| 4,674,737 | 6/1987 | Murayoshi | 271/124 |
| 4,676,498 | 6/1987 | Kanemitsu et al. | 271/229 X |

FOREIGN PATENT DOCUMENTS

| | | | |
|---|---|---|---|
| 57-4838 | 1/1982 | Japan | 271/121 |

*Primary Examiner*—Joseph J. Rolla
*Assistant Examiner*—Edward S. Ammeen
*Attorney, Agent, or Firm*—Robert E. Cumha

[57] ABSTRACT

This paper feeding mechanism comprises a first spring for biasing a stack of paper against a belt for driving one or two sheets of paper from the stack toward a gap which is slightly larger than the width of one sheet of paper, and a second spring for flattening the selected sheet or sheets against the belt just prior to entering the gap. The belt is held solidly in position by a backing Teflon block to form one side of the gap, and a sharp edge that is positionally adjustable forms the other side. The sharp edge is rounded slightly to compensate for the possibility of mechanical inaccuracies, and the second spring presses the paper against the belt just prior to the knife edge for more reliable operation with stiff paper.

4 Claims, 5 Drawing Sheets

PAPER FEEDING DEVICE

BACKGROUND OF THE INVENTION

This invention is a paper feeding mechanism for preventing more than one sheet of paper from being delivered to a gripper bar and more specifically comprises a first biasing means for pressing the stack against the belt to pull one or more sheets from the stack and a second biasing means for flattening those selected sheets against the belt so that an accurate gap can prevent more than one sheet from going onward toward the gripper bar.

Computer cards are typically placed into a computer in the form of a stack. The card reader then reads each card. A typical mechanism for preventing the feeding of more than one card at a time is described in an IBM Technical Disclosure Bulletin, Vol. 14 No. 8 January 1972, Vernierly Adjustable Throat for Document Card Hoppers by J. R. Reidenbach. A set of rollers drives one or two cards from the bottom of a stack toward a gap defined by an adjustable ramp 12 and a fixed knife 10. The gap is adjusted to allow only one card at a time to pass.

A similar mechanism is described in a U.S. Pat. No. 4,004,795, Hopper Mechanism by Agnew et al. Here the vertically stacked cards are driven downward into a gap defined by a fixed knife 52 and an adjustable ramp 50. Another mechanism is described in U.S. Pat. No. 3,874,652, Apparatus for Feeding Sheet Material from the Bottom of a Stack by Robert A. Bilbrey. A loader plate 45 presses the forward edge of the stack against the moving belt, forcing one or two sheets forward. The adjustable gap between the belt and the gate 85 then allows only one sheet to pass.

A special case arises when the stack to be fed comprises sheets of paper with a forward edge length of $8\frac{1}{2}$ inches (18.7 cm) rather than a few inches in the case of a computer card. The problem is compounded if the paper is rigid or stiff, as is the case in a system which develops x-ray images. The greater rigidity of the sheet results in a greater likelihood of sheet warping, the longer distances between mechanism elements lead to a greater probability of mechanical misalignments, and together these result in a greater likelihood of paper jams. What is required is a page-sized paper feeder which will feed one sheet of stiff paper at a time while minimizing paper jams.

SUMMARY OF THE INVENTION

The basic mechanism of this invention is similar to those described above in that there is a means for biasing the forward edge of the stack against a moving belt to pull out from the stack one or two sheets, and a gap for preventing more than one sheet from advancing. The main difference is that there is a second biasing means immediately before the gap that contacts the one or more sheets that are pulled from the stack to flatten them against the belt before those sheets are contacted by the knife edge at the gap. The belt is backed up by a flat Teflon surface to accurately maintain the belt position. The result is improved reliability and fewer paper jams.

More specifically, in the IBM Bulletin there is no biasing means shown. It is assumed that the weight of the cards and an additional weight added to the top of the stack are the possible biasing means for pressing the cards against the ramp 12 at the point just before the knife 10. To the extent that the bottom card may be warped or buckled, the pressure of the stack and the additional weight, distributed over the entire deck, may not be sufficiently focused to flatten the left edge of the bottom card, and a jam will result. In Agnew et al. and in Bilbrey the biasing means 58 and the loader plate 45, respectively, also press on the other side of the stack at a distance from the point of contact with the belt, making full contact of the first sheet and the belt less likely.

In this invention there are two biasing means, one which presses the stack against the belt to advance one or more sheets, and a second which presses on the one or more advanced sheets to guarantee that these few sheets are held uniformly against the belt to ensure that only one sheet advances through the gap.

DETAILED DESCRIPTION OF THE INVENTION

Figure 1:
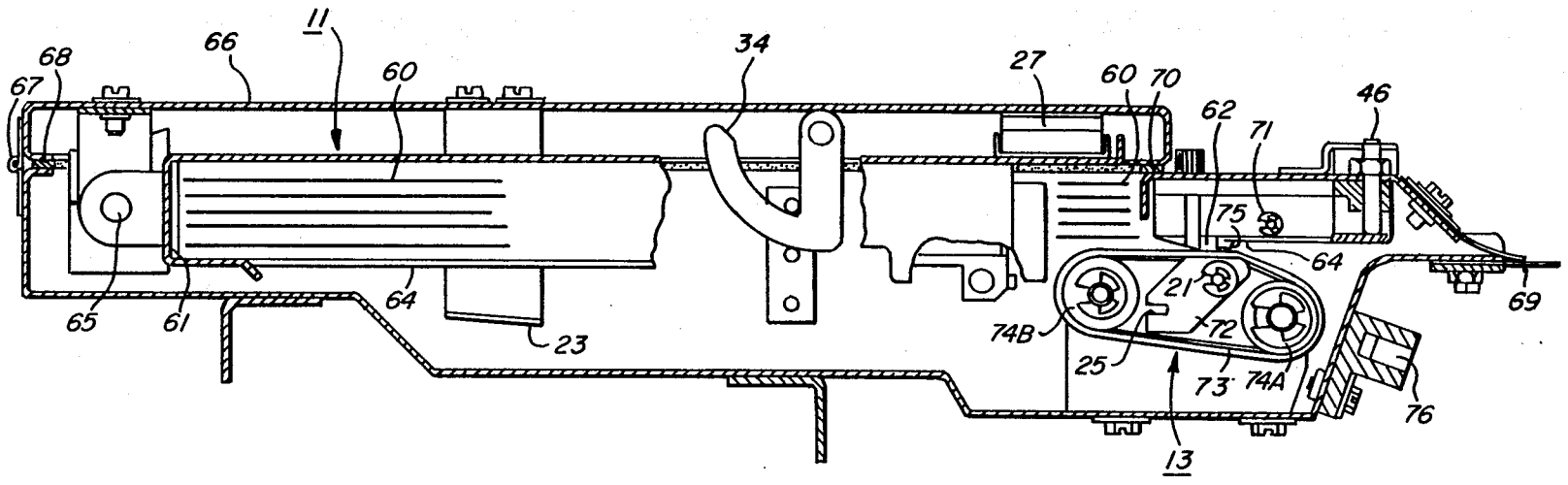
FIG. 1 is a cross sectional drawing of the paper tray enclosure assembly.

Referring to FIG. 1, the paper used in the described embodiment is originally inserted into the paper tray 11 in the form of a stack 60 which rests on the bottom 61 of the paper tray 11. The tray 11 and paper 60 extend upward into the space between the spring 27 and the rotating Isoprene belt 13. This belt is driven by the upper roller 74*a* which, in turn, is driven by a motor, not shown. The spring 27 is biased against the tray 11 which is designed to rotate a few degrees about pivot 65, thereby forcing the paper 60 against the rotating belt 13. This spring is a leaf spring comprising one sheet of spring steel, the long dimension of the leaf being perpendicular to the page of FIG. 1. The belt 13 normally rotates in a clockwise direction, which tends to drive the bottom sheet or sheets of the stack 60 upward. The left surface of the driven sheet first contacts the gate 62 which is biased to the right by a spring, not shown. In case more than one sheet is picked up by the belt 13, the gate will flatten all sheets against the belt. The lateral position of the belt 13 is maintained in relation to the Teflon block 72 and rollers 74 by means of a raised rib 73 which runs along the center of the inside surface of the belt, and which mates with matching grooves along the left side of the block 72 against which the belt bears, and along the circumference of the rollers 74*a* and 74*b*.

Stop 64 is a sharp edge defining a gap between said stop 64 and the belt 13, the gap being just slightly larger than the thickness of one sheet of paper. In case several sheets of paper were picked up by the belt, the stop 64 will stop the sheet or sheets to the left, and allow only the one to the right to continue on. Finally, the sheet that is passed through the gap will push aside flexible wiper 69 and will protrude far enough to be clamped onto by the gripper bar, not shown, which will pull the sheet through the remainder of the system.

In case a paper jam occurs wherein a sheet is partially advanced so that the top of the sheet is past the gap between the belt 13 and the stop 64 but the lower portion of the page is still in the tray 11, the paper itself prevents the sidewall 66 from being opened to clear the jam. Under this condition it is convenient for the operator to be able to manually retract the sheet backward until it is entirely within the paper tray. The paper trailing edge in this case is still between the belt 13 and the spring loaded gate 62 providing friction sufficient to allow the paper to be driven down into the enclosure by means of the knob 18, not shown in this figure. Rotation in the counterclockwise direction pushes the paper back into the enclosure. For this purpose a knob is provided which is part of the upper roller assembly 74*a* for rotating the roller. The gear train connecting the motor to the roller is geared down far enough that turning the roller 74*a* would be difficult at best. To allow the roller to be turned there is a twenty-three inch-ounce (16 meter-gram) slip clutch provided between the roller 74*a* and the motor to allow manual roller rotation.

This slip clutch has another purpose. In normal operation the belt 13 drives the paper forward into the gripper bar. If the paper is driven too far while the leading edge of the paper is stopped at the gripper, the paper will buckle, possibly causing a paper jam. To prevent this over-travel, the slip clutch is designed to slip when the paper contacts the far end of the gripper throat.

There is an additional one way clutch inside roller 74*a* which allows the roller 74*a* and belt 13 to freely rotate clockwise while the motor is not running. This feature is used when the gripper bar has gripped, and is pulling, the paper. Under this condition, if the drag on the paper is too high, the paper will pull out from the gripper. To minimize this occurrence, the one way clutch allows the roller 74*a* to freely rotate, without the necessity of overcoming the drag of the slip clutch.

The gap between the stop 64 and the belt 13 is adjustable. On the right side of the gap 75, the belt is flattened against the flat Teflon block 72 by the pressure of the tension in the belt 13 and by the pressure of the gate 62 which is spring-biased to the right. On the left, the stop 64 is an elongated member which pivots a few degrees about a shaft 71 under the adjustment of screw 46. By this screw 46 adjustment, the gap can be made exactly large enough to reliably admit only one sheet.

The paper tray 11 is loaded by first rotating latch 34 counterclockwise, and then tilting the lid 66 about hinge point 67 to the left until the bracket 23 contacts the stop 64. The tray 11 will come out with the lid, and paper can then be loaded into the tray 11 from the top. The paper as delivered from the vendor contains a predetermined amount of moisture, and this moisture content must be maintained while the paper is within the tray 11. This is accomplished by sealing the entire paper tray enclosure assembly. Specifically, a foam rubber seal 68 is provided to seal the gap above the hinge 67, another seal 70 is provided at the top of the sidewall 66 and the Mylar wiper 69 provides an airtight seal before and after the passage of a sheet of paper.

The entire paper tray enclosure assembly is located in relation to the remainder of the cabinet by means of a locating slot 76. Internally, a build-up of tolerances can prevent the stop 64 and gate 62 from being perfectly aligned to the surface of the block 72. The solution selected was to make the gate 62 flexibly mounted so that it is free to move rotationally and translationally a small amount so that, when biased to the right, it will always line up exactly with the surface of the belt 13 and block 72. In addition, the surface of the stop 64 which is generally in parallel with the surface of the block 72 is rounded along a four inch (8.8 cm) radius to create a gap that is wider at the edges of the belt than at the center of the belt so that, in case of a slight angular misalignment that results in the stop edge 64 not being perfectly parallel to said belt 13., the second sheet will be blocked by a substantial length of the stop 64 rather than by a sharp corner.

Figure 2A:
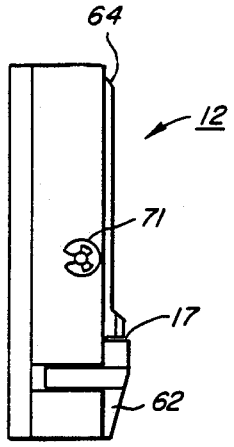
FIGS. 2*a*, 2*b* and 2*c* are views of the gate assembly.
Figure 2B:
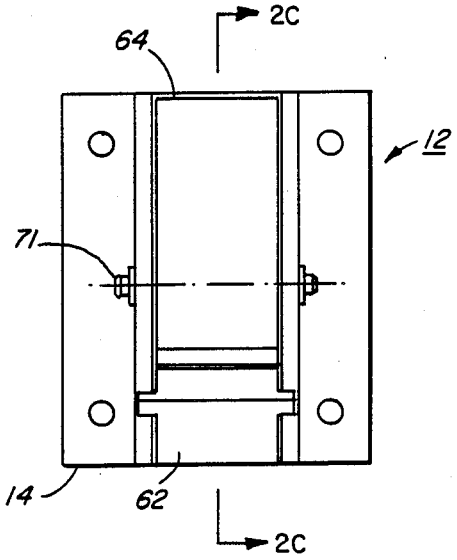
Figure 2C:
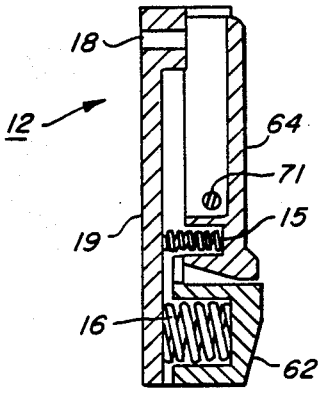

FIGS. 2*a* and 2*b* are end and front views of the gate assembly, and FIG. 2*c* is a view along section A—A of FIG. 2*b*. FIG. 2*a* shows the side view of the stop 64, including the sharp lower edge 17 which stops the second sheet of paper from advancing out of the paper tray. The stop pivots about shaft 71. Also shown in this view is the gate 62 in the position it would have in the absence of a sheet of paper. A single sheet of paper in the gap would push the right edge of the gate back to approximately the same position as the edge 17. Two sheets would push this gate further to the left.

FIG. 2*b* shows front views of the gate 62, stop 64, shaft 71 and the mount 14. Section A—A of FIG. 2*b* is shown as FIG. 2*c*. The stop 64 pivots about shaft 71. Spring 15 forces the stop in a counterclockwise direction, the amount limited by the adjustment screw in hole 18. The gate 62 is also driven to the right by a spring 16. The mechanical restraints between the gate 62 and the base 19 of the gate assembly 12 allow translational as well as rotational movement of the gate 62, allowing the gate surface to align itself with the surface of the belt. This flexible mounting also assures that paper can be moved either forward or backward to clear jams.

Figure 2D:
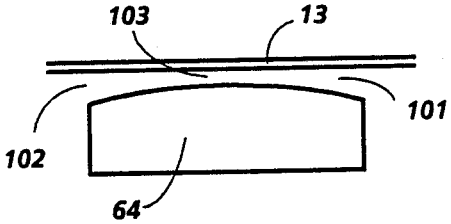
FIG. 2*d* is a view of the bottom surface of the stop.

FIG. 2*d* is a view of the bottom surface of the stop 64 showing the arcuate edge, the curvature of which creates a gap between it and the belt 13 which is narrower at the center 103 than at the edges 101, 102.

Figure 3A:
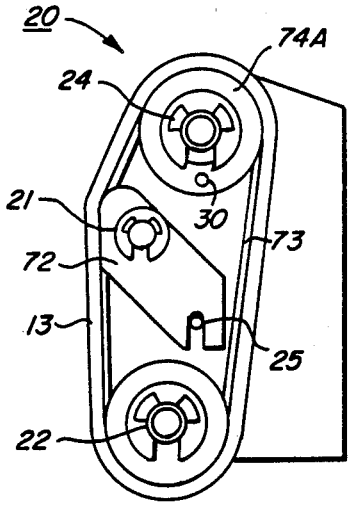
FIGS. 3*a* and 3*b* are views of the belt assembly.
Figure 3B:
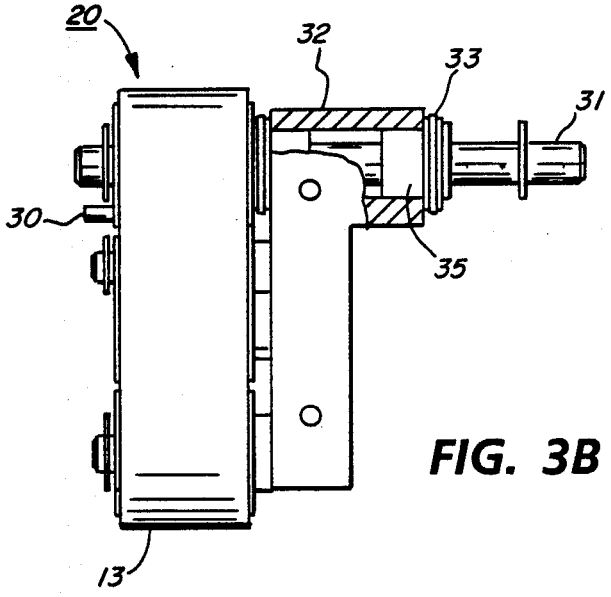

FIGS. 3*a* and 3*b* are front and side views of the belt assembly 20. As shown in FIG. 3*a*, the block 72 is held in place by means of shaft 21 and pin 25. This view also shows a pin 30 protruding from the front of roller 74*a*. This is provided to mate with a manually driven shaft for driving the roller 74*a* backward to clear jams. FIG. 3*b* shows the pin 30 protruding from the front of the belt assembly 20. To the rear of the belt 13 is shown the continuation of the shaft 31, held in place by a bearing 35 and a spacer 33 within a mounting block 32.

Figure 4B:
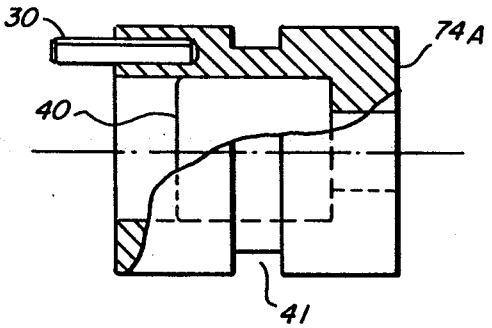
FIGS. 4*a* and 4*b* are views of the clutch and pulley assembly.
Figure 4A:
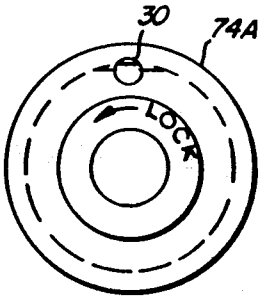

FIGS. 4*a* and 4*b* are two views of the roller 74*a*. In FIG. 4*b* the motor is to the right and the manual shaft fits over the pin 30 to the left. The central portion of the roller 74*a* contains a one-way clutch 40 which couples the roller 74*a* to a shaft 31, not shown, which extends from the right side of the roller. Also shown is the groove 41 which mates with the rib on the inside surface of the belt. FIG. 4*a* is an end view of the roller of FIG. 4*b* showing the location of the pin 30 and the locking direction of the clutch.

Figure 5:
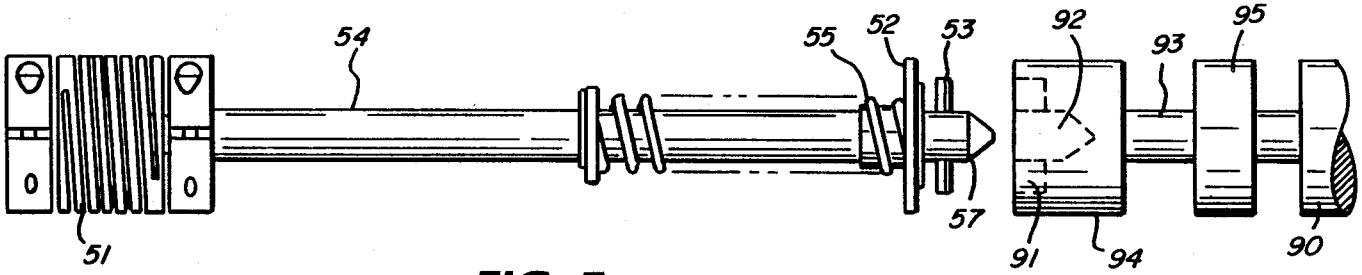
FIG. 5 is a diagram of the shaft assembly.

FIG. 5 is a diagram of the shaft assembly which couples the roller 74*a* to the motor 90. Only that part of the shaft 54 shown to the right of the bushing 52 protrudes from the paper tray assembly. To maintain the paper tray assembly as an airtight enclosure, the bushing 52 is driven against the shaft hole by spring 55. When the paper tray assembly is inserted into the system, the tapered right end of shaft 54 will tend to slide into a mating hole 92 in the motor shaft coupling 94. Then as the motor 90 rotates, the pin 52 will eventually line up with, and fall into, a matching slot 91 in the motor shaft assembly. To the extent that there is a build up of tolerances, flexible coupling 51 is provided. This coupling is designed to be compressible in the lateral direction and also to allow some angular freedom so that any misalignment between the motor shaft assembly and this shaft 54 will be accommodated by this coupling 51. The coupling 94 is connected through a shaft 93 to the slip clutch 95 which is connected, in turn to the motor 90. Motor 90 and clutch 95 can be any commercially available part.

Figure 6:
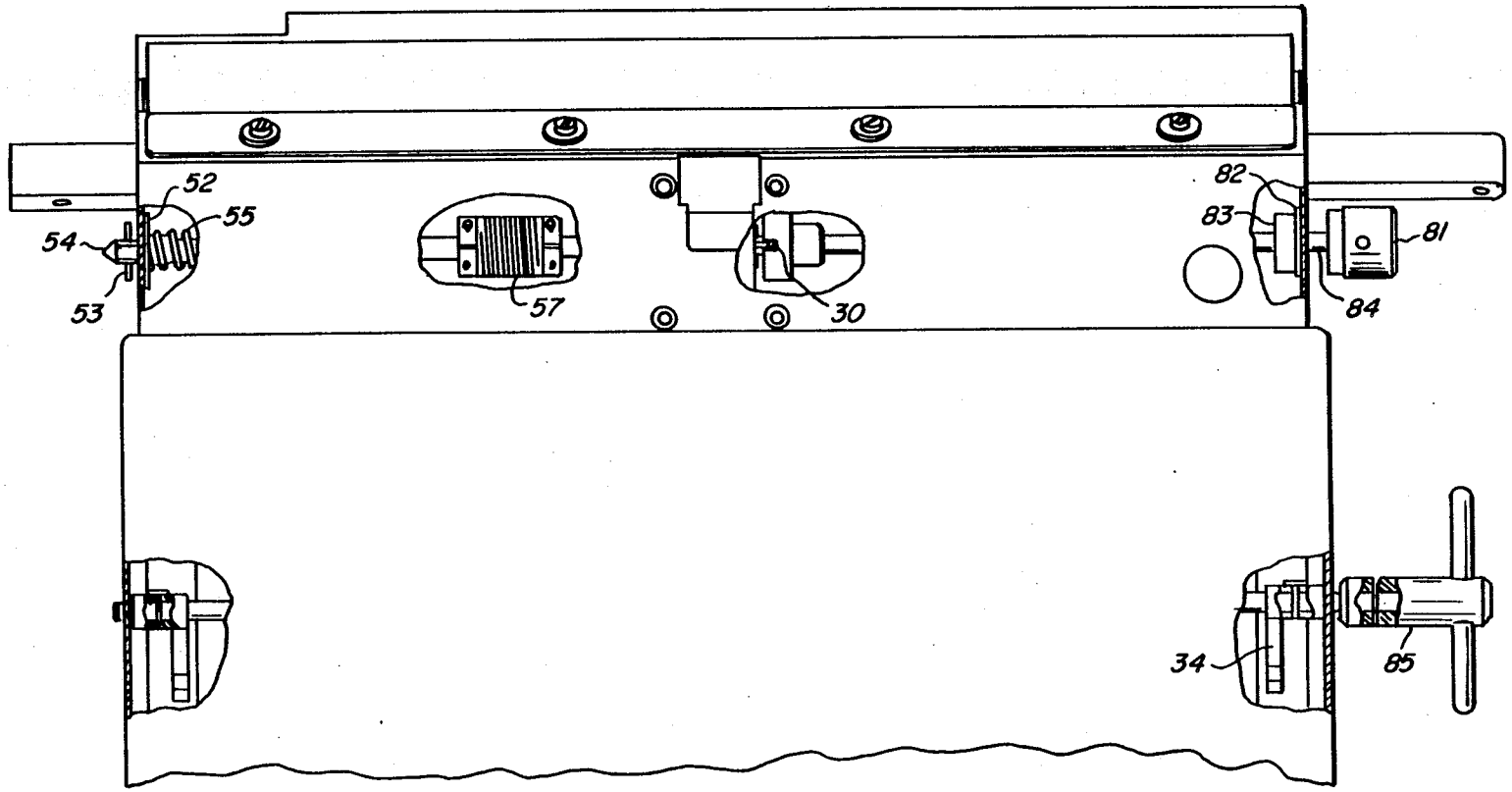
FIG. 6 is a diagram of the enclosure assembly.

The overall arrangement of the components is shown in FIG. 6. At the right there is a manually rotated shaft 84 driven by a knob 81 which is outside, and in front of, the paper tray enclosure. This shaft is fitted through an airtight seal 82 and a collar 83 and connects to the roller by mating with pin 30. To the rear of the enclosure the roller 74*a*, not shown, is coupled through the flexible coupling 51 to shaft 54 containing pin 53 which fits into a matching slot of the motor. The hole for the shaft 54 is sealed by bushing 52 biased against the hole by spring 55. This figure also shows the latch 34 inside the enclosure and its associated handle 85 outside.

While the invention has been described with reference to a specific embodiment, it will be understood by those skilled in the art that various changes may be made and equivalents may be substituted for elements thereof without departing from the true spirit and scope of the invention. In addition, many modifications may be made without departing from the essential teachings of the invention.

I claim:

1. A paper feeding mechanism for feeding one sheet from a stack of sheets comprising:

a flat surface, forward and rear rollers positioned forward and to the rear of said flat surface, a continuous belt adapted to be driven continuously forward across said surface and around said rollers, said belt and rollers positioned in relation to said stack so that a forward edge of the first sheet in said stack is in contact with a rear portion of said belt adjacent said rear roller, means for biasing a forward edge of said stack against said belt, to feed one or several sheets forward, means adjacent said flat surface for pressing said one or several sheets against said belt, and a stop immediately forward of said means for pressing comprising an edge adjacent and parallel to said flat surface defining a gap between said edge and said belt, the size of said gap being between one and two sheet widths, to prevent more than one sheet from passing through said gap, and wherein said stop edge is rounded into an arc as viewed from the rear to create said gap that is wider at the edges of the belt than at the center of the belt to compensate for mechanical misalignments that result in said edge not being perfectly parallel to said belt.

2. The mechanism of claim 1 wherein said means for pressing comprises a pressing surface that is parallel to said flat surface and a spring for pressing said pressing surface against said belt, said pressing surface being mounted freely at one end of said spring to allow said pressing surface to move rotationally about all axes which are parallel to the plane of said belt and translationally toward and away from said belt, so that the pressing surface of said means for pressing adjacent said flat surface will remain parallel to said flat surface in the presence of mechanical misalignments.

3. A paper feeder for selecting a single sheet of paper from a stack of sheets stacked so as to have their planar sufaces vertical comprising:

a flat vertical surface parallel to the plane of said sheets, a first roller above said flat surface, a second roller below said flat surface, the leftmost point on the circumference of said second roller being directly below said flat surface, said second roller being adjacent to an upper end of the stack, a belt in the form of a loop adapted to travel around said rollers in a clockwise direction, contacting the left side of said flat surface, a first biasing means for biasing said stack against said second roller to drive one or several sheets upward, a second biasing means for pressing said one or several sheets against said belt, and an edge positioned immediately above said second biasing means and slightly more than one sheet thickness to the left of said belt to form a gap therebetween, to prevent more than one sheet from passing upward through said gap, and wherein said edge is rounded into an arc as viewed from the bottom to create said gap that is wider at the edges of the belt than at the center of the belt to compensate for mechanical misalignments that result in said edge not being perfectly paralled to said belt.

4. The mechanism of claim 3 wherein said second biasing means comprises a spring and a bising surface mounted freely at one end of said spring and biased against said flat surface so that said biasing surface will remain parallel to said flat surface in the presence of mechanical misalignments by being free to rotate about all axes parallel to the plane of said belt.

* * * * *